US005209384A

United States Patent [19]

Anderson

[11] Patent Number: 5,209,384

[45] Date of Patent: May 11, 1993

[54] PORTABLE TOOL KIT

[76] Inventor: Scott M. Anderson, 911 State St., #2, Kirkland, Wash. 98033

[21] Appl. No.: 575,596

[22] Filed: Aug. 31, 1990

[51] Int. Cl.[5] ..... A45F 3/04; B65D 25/10

[52] U.S. Cl. ..... 224/209; 224/242; 224/245; 224/223

[58] Field of Search ..... 224/209-216, 224/223, 242, 245, 32 A; 206/234, 373, 438; 190/903, 107, 108, 109, 110, 111; 229/237

[56] References Cited

U.S. PATENT DOCUMENTS

| | | | |
|---|---|---|---|
| 1,508,204 | 9/1924 | Walker | 206/234 |
| 2,324,194 | 6/1943 | Campiglia | 224/215 |
| 2,474,752 | 6/1949 | Montgomery | 224/245 |
| 2,558,382 | 6/1951 | Previdi | 224/223 |
| 2,744,621 | 5/1956 | Kegevic | 206/234 |
| 2,792,980 | 5/1957 | Brown | 224/209 |
| 3,061,057 | 10/1962 | Miller | 190/111 |
| 3,321,120 | 5/1967 | Cunningham | 224/209 |
| 3,443,671 | 5/1969 | Dyke | 190/110 |
| 3,549,064 | 12/1970 | Wilson | 222/151 |
| 4,081,061 | 3/1978 | Tucker | 383/17 |
| 4,236,657 | 12/1980 | Brunton | 224/153 |
| 4,513,866 | 4/1985 | Thomas | 206/570 |
| 4,561,576 | 12/1985 | Lowe et al. | 224/209 |
| 4,793,508 | 12/1988 | Thompson | 206/373 |

FOREIGN PATENT DOCUMENTS 3628311 2/1988 Fed. Rep. of Germany ..... 224/213

*Primary Examiner*—Henry J. Recla
*Assistant Examiner*—David J. Walczak
*Attorney, Agent, or Firm*—Michael J. Folise

[57] ABSTRACT

The present invention discloses a portable tool kit which allows the organization and transportation of a complete set of hand tools by an individual to a remote repair location while leaving the individual's hands free. The invention has a front panel, a back panel, a top, a bottom, and at least two sides. Arm straps are attached to the back panel to enable a user to wear the portable tool kit like a backpack. The portable tool kit also has a plurality of vertically oriented tool storage compartments wherein each tool storage compartment lies in a plane which is substantially parallel to the front and back panels of the tool kit. Tool holders of various configurations are attached to panels making up the tool storage compartments. The various configurations of the tool holders are designed to accommodate a variety of different types and sizes of hand tools while holding the hand tools in place when the tool compartments are closed for transportation. Each tool compartment has an individual opening and sealing means.

4 Claims, 8 Drawing Sheets

PORTABLE TOOL KIT

TECHNICAL FIELD

The present invention relates to a portable kit which enables an individual to transport a complete set of hand tools with relative ease and convenience. More particularly, the present invention relates to a portable tool kit with a plurality of vertically oriented tool storage compartments, each compartment being configured with tool holders of varying configurations so that once tools are placed in their appropriate holder they will remain in place until they are needed by the operator. Each tool storage compartment has a separate sealing device.

BACKGROUND OF THE INVENTION

The transportation required to do repair work at remote locations within complex machinery or apparatus such as technicians or engineers in an oil refinery or on board a ship are constantly faced with the problem of how best to transport the complete set of hand tools needed to do their job. Unlike carpenters or electricians at a construction site, such technicians or engineers frequently need a relatively complete set of hand tools including wrenches, ratchets, hammers, pillars, etc. In addition, the repair person needs tools to be organized for efficient repair work due to the number and variety of the hand tools in the tool set. Not only do such tools present a problem with their combined weight, they are also inherently unsuited for any sort of normal stacking or packing methods to be transported easily in a compact manner. Conventional methods for storing and transporting tools such as tool boxes, while quite appropriate in conventional settings such as automobile garages, etc., have a number of disadvantages in situations discussed above where the technician or engineer is transported to the repair site. First, the individual using the tools may be required to climb ladders or perform other physical acts which require the individual to have both hands free at the time. Further, since conventional tool boxes are designed to use only one hand, transporting heavy hand tools becomes increasingly difficult over any distance using a single-handed tool box. In addition, the tool box is not designed to be oriented in any direction since the tools are usually arrayed in trays. Thus, if the tool box becomes upended or turned upside down, the tools will be scattered throughout the tool box.

Other areas which have attempted to solve similar problems have found an adaptation of a conventional backpack to be quite useful. See, for example, U.S. Pat. No. 4,513,866 to Thomas for transporting medical supplies and U.S. Pat. No. 4,561,576 to Lowe et al. for transporting video equipment. While such applications show some promise, they do not address the specific problem created by transporting hand tools discussed above. That is, their entire transportability for normal packing methods. Thus, the main compartment of a conventional backpack with the adaptation discussed herein would still present many of the same problems presented by a conventional tool box. That is, the tools would be able to shift as the pack is placed in a different orientation and there would be a lack of organization. It is very time consuming and very inconvenient to someone trying to find a specific wrench when dozens, even hundreds of different tools could be involved in a relatively complete set. At the same time, the conventional backpack shows a great deal of promise in an application to solve the problem discussed herein, in that it allows a fairly significant amount of weight to be carried while leaving the individual's hands free.

As stated by the above discussions, there are a number of features that would be desirable for a portable tool kit. It would be desirable for a portable tool kit to incorporate the load-carrying characteristics of a conventional backpack. It would also be desirable for a portable tool kit to enable tools to be transported by an individual while leaving the individual's hands free. In addition, it would also be desirable for a portable tool kit to keep individual tools in place and organized regardless of the orientation of the tool kit. Further, it would be desirable for the tool kit to allow the maximum amount of comfort to the wearer while transporting the tools to a desired repair site.

While the discussion herein relates to portable tool kits, it is not intended that the invention be limited to this situation. It is obvious from the description that follows that the present invention will be useful in other applications with problems common to those described herein.

DISCLOSURE OF THE INVENTION

It is the object of the present invention to provide a portable tool kit which allows an individual to transport a relatively complete set of hand tools to a desired repair location while leaving the individual's hands free for physical activity.

It is a further object of the present invention to provide a portable tool kit which allows hand tools to be remina organized and in place regardless of the orientation of the portable tool kit during transportation.

It is also the object of the present invention to provide a portable tool kit to maximize comfort to the individual transporting the tools.

The present invention achieves these and other objectives which will become apparent from the description that follows, by providing a portable tool kit which utilizes the external structure of a relatively conventional backpack with a back panel, a front panel, a bottom, at least two sides, and a top. Arm straps are fixedly attached to the back panel, thus enabling an individual using the tool pack to transport tools while leaving the individual's hands free. The portable tool pack has a plurality of vertically oriented tool storage compartments. Each compartment has tool holders configured for specific hand tools. When a hand tool is placed within the corresponding tool holder and the tool storage compartment is closed, the hand tool will remain in its holder regardless of the orientation of the portable tool kit. Each individual tool compartment has a separate and independent opening and sealing means.

In an alternate preferred embodiment, the vertically oriented tool storage compartments have internal panels, which are substantially the same size and shape as the front and back panels of the portable tool kit. Each panel is attached about its edge to the bottom, sides and top of the portable tool kit. Thus, each tool storage compartment is defined by their two adjacent internal panels or an internal panel and either the front or back panels along with those portions of the tool kit top, bottom, and sides that lie between the adjacent panels. The internal panels can be made of two pieces of material connected together as they are connected to the top, bottom, and sides of the tool kit. These panels lie in planes that are substantially parallel to the planes defined by the front and back panels of the portable tool kit. In this embodiment, the independent opening and sealing means is a medium to heavy gauge zipper for each compartment, with the compartment opening across the top and the opposing sides of the portable tool kit.

In a further alternative preferred embodiment, the tool holder has several different configurations to enable the organization and retention of a variety of hand tools. The tool holders are constructed from strips of material attached to an internal wall in a plurality of vertical attachment lines to form loops in which to hold the hand tools. This material may be elastic or non-elastic. Other tool holders can be formed by use of a material of a sufficient width to form a plurality of pockets with closed and open ends so that the hand tools may be placed in the open end. These pockets are oriented so that when the tool storage compartment is closed, the tools are close enough to the top of the tool storage compartment that it forms a lid to prevent the tools from coming out of the pocket. Alternatively, with a flap that pulls down over the open end of the tool pocket to prevent the tools from moving or falling out of the tool pocket. Such pockets can also be provided with a thin strip of elastic material or cord across the open end of each of the pockets so that some pressure has to be exerted to insert the hand tool into the pocket, and once inserted, the elastic will hold the hand tool in place. Tool holders of different configurations can be placed on one panel and can be arrayed to most efficiently allow the packing and transportation of the hand tools in the tool set. The tool storage compartments use opposing sides of the internal panels with tool holders for each specific compartment on one side of the internal panel. Internal panels can be constructed from two pieces of material sew together at the edges.

In an additional alternative preferred embodiment, a portable tool kit constructed substantially in accordance with the above invention is used. The portable tool kit of this embodiment also has external miscellaneous storage areas including pockets and hangers.

In yet another alternative preferred embodiment, the internal and external walls or panels of the portable tool kit are made from a flexible, substantially now elastic material, thus allowing the tool kit to conform somewhat to the individual transporting the tools.

A further alternative preferred embodiment is provided by constructing a portable tool kit that has interchangeable internal panels with tool holders which allow tool holders for specific applications to be changed or for the overall portable tool kit to be expanded.

BEST MODE IN CARRYING OUT THE INVENTION

Figure 1:
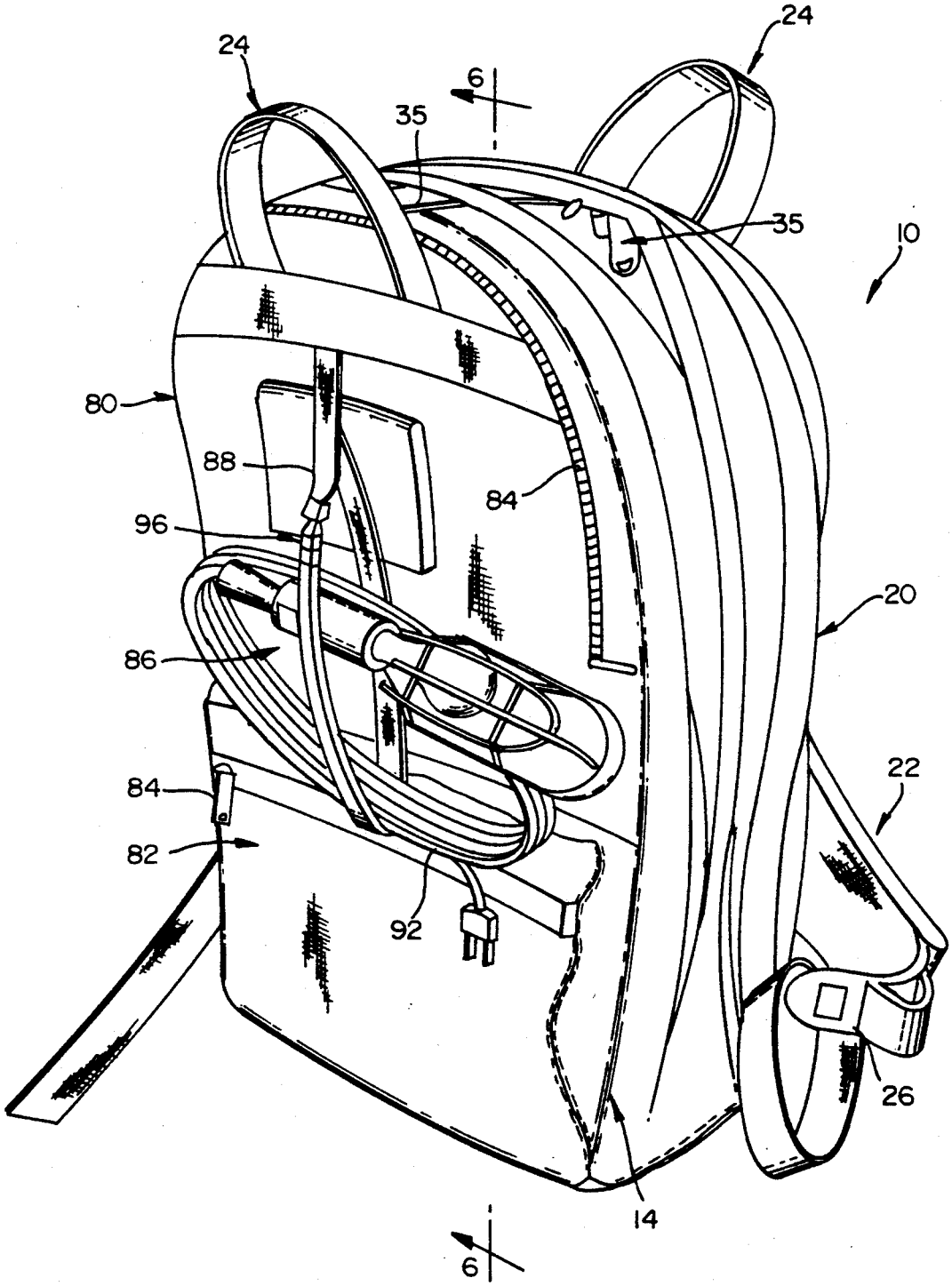
FIG. 1 is a front perspective view of a preferred constructed in accordance with the present invention.
Figure 1A:
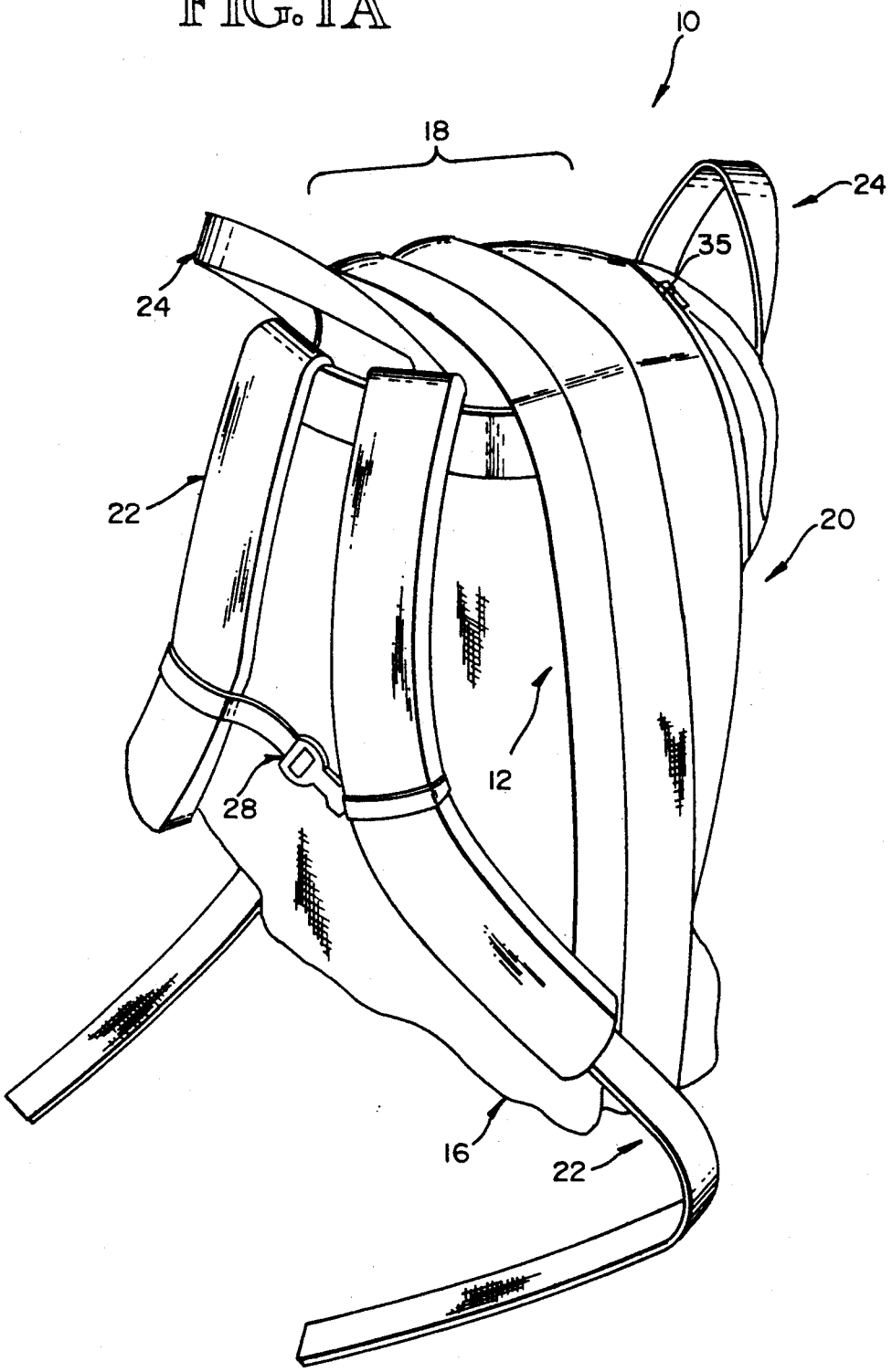
FIG. 1*a* is a back perspective view of a preferred embodiment constructed in accordance with the present invention.
Figure 2:
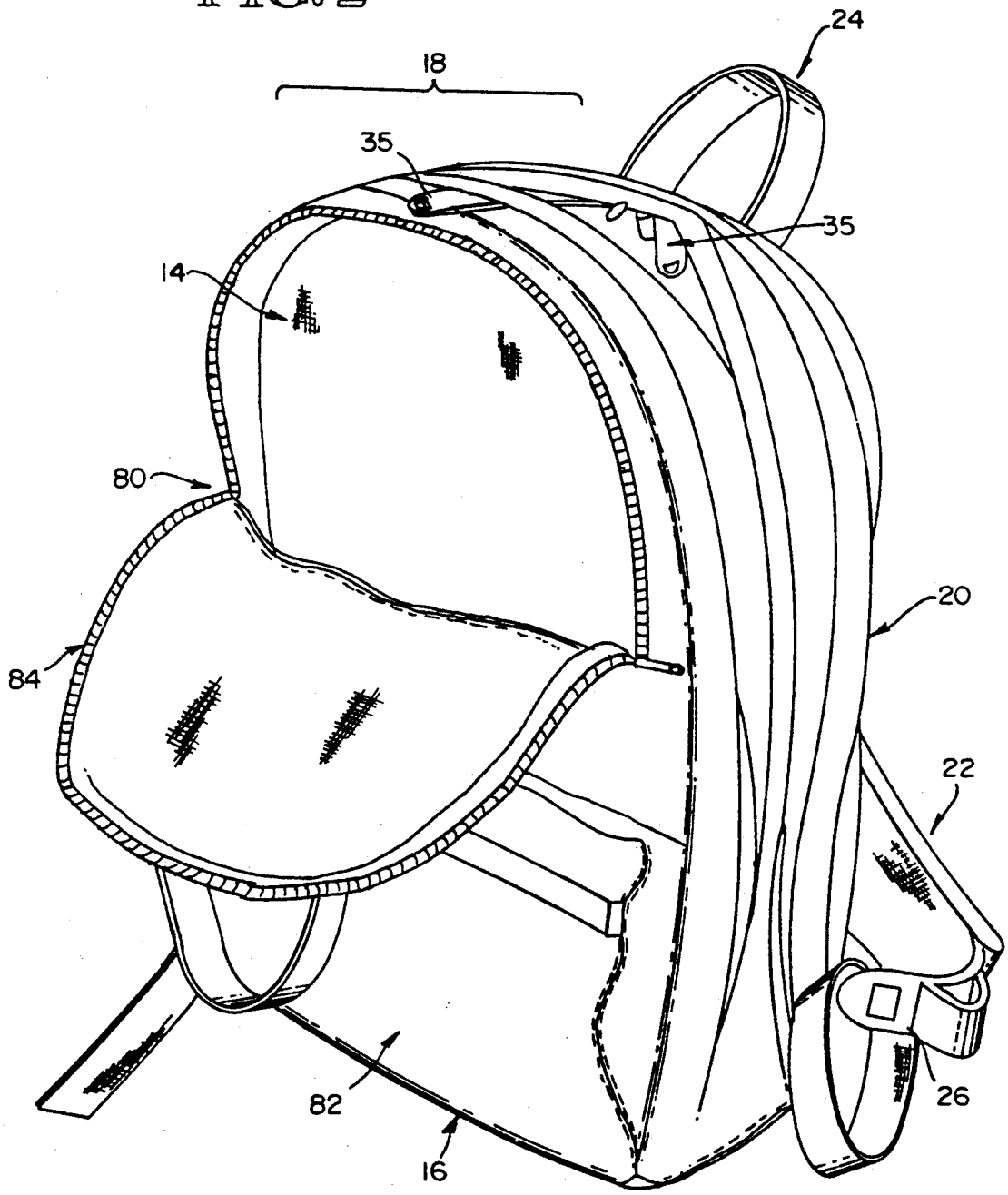
FIG. 2 is a front perspective view of a preferred embodiment constructed in accordance with the present invention showing alteration of one element of the invention.

With reference to FIG.'S 1 and 1*a*, a portable tool kit 10 with an external configuration based on a relatively conventional backpack is shown. The tool kit has a back panel 12, a front panel 14, a bottom 16, a top 18, and at least two sides 20. Arm straps 22 are fixedly attached to the back panel of the tool kit proximate the top and bottom of the tool kit. Additional lift straps 24 are provided at the top of the pack to allow it to be picked up by one hand when it is not necessary or desirable to use the arm straps. The arm straps are adjustable as shown in this embodiment using the adjustment buckles 26. The arm straps may also have a cross strap 28 to attach the arm straps together and help secure the load.

Figure 3:
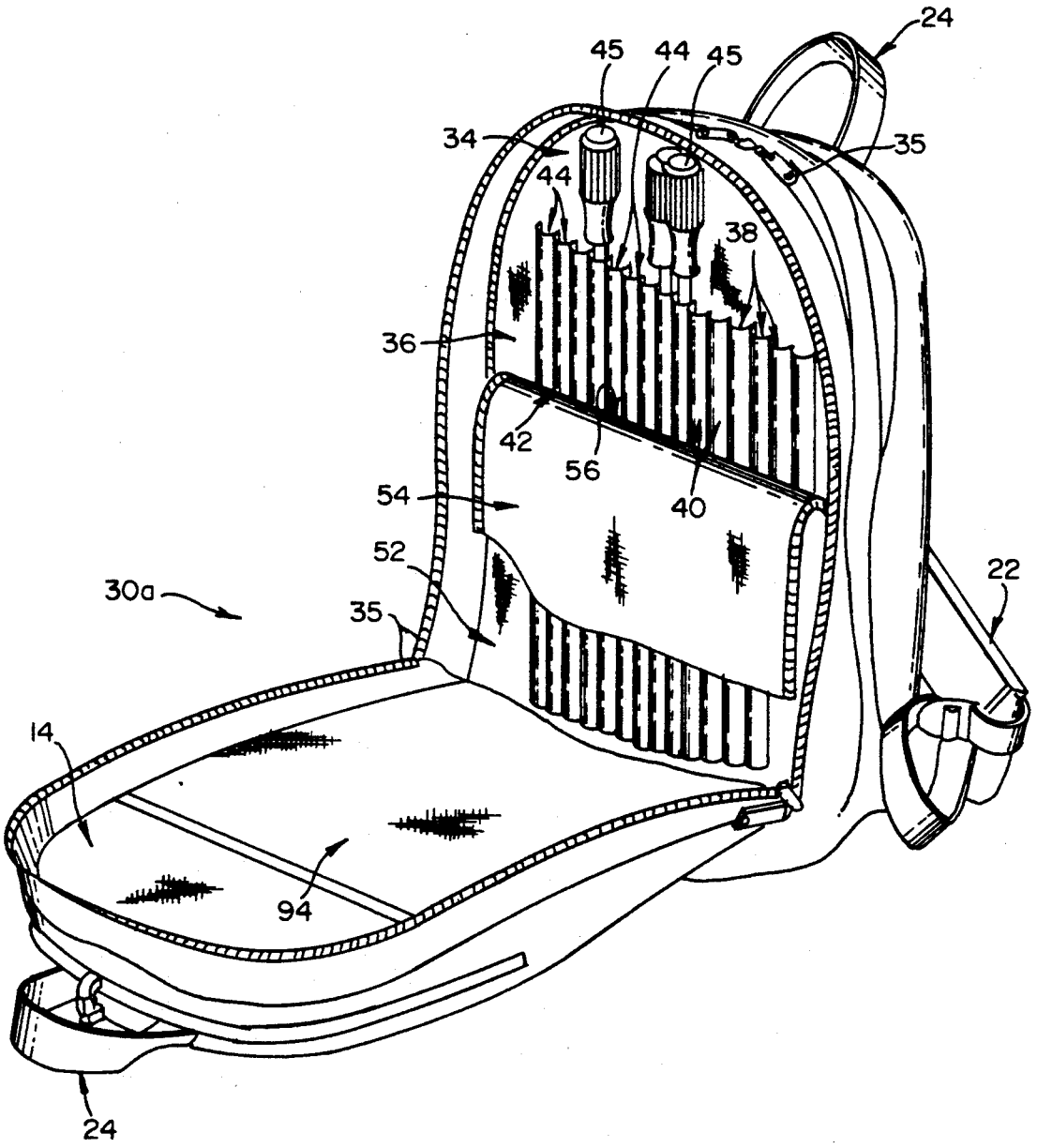
FIG. 3 is a front perspective view of a preferred embodiment constructed in accordance with the present invention showing a tool storage compartment.
Figure 4:
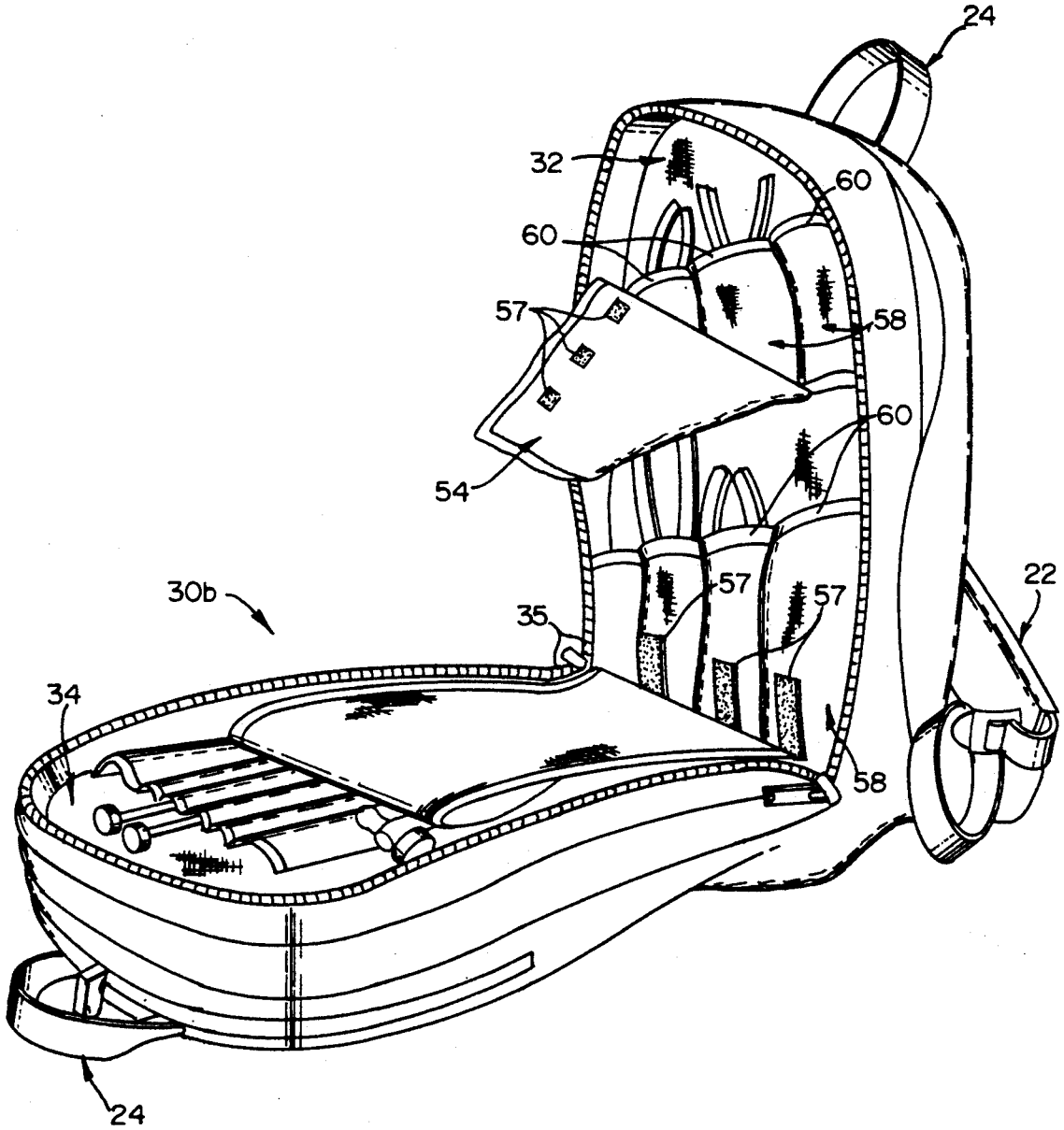
FIG. 4 is a front perspective view of a preferred embodiment constructed in accordance with the present invention showing a tool storage compartment.
Figure 5:
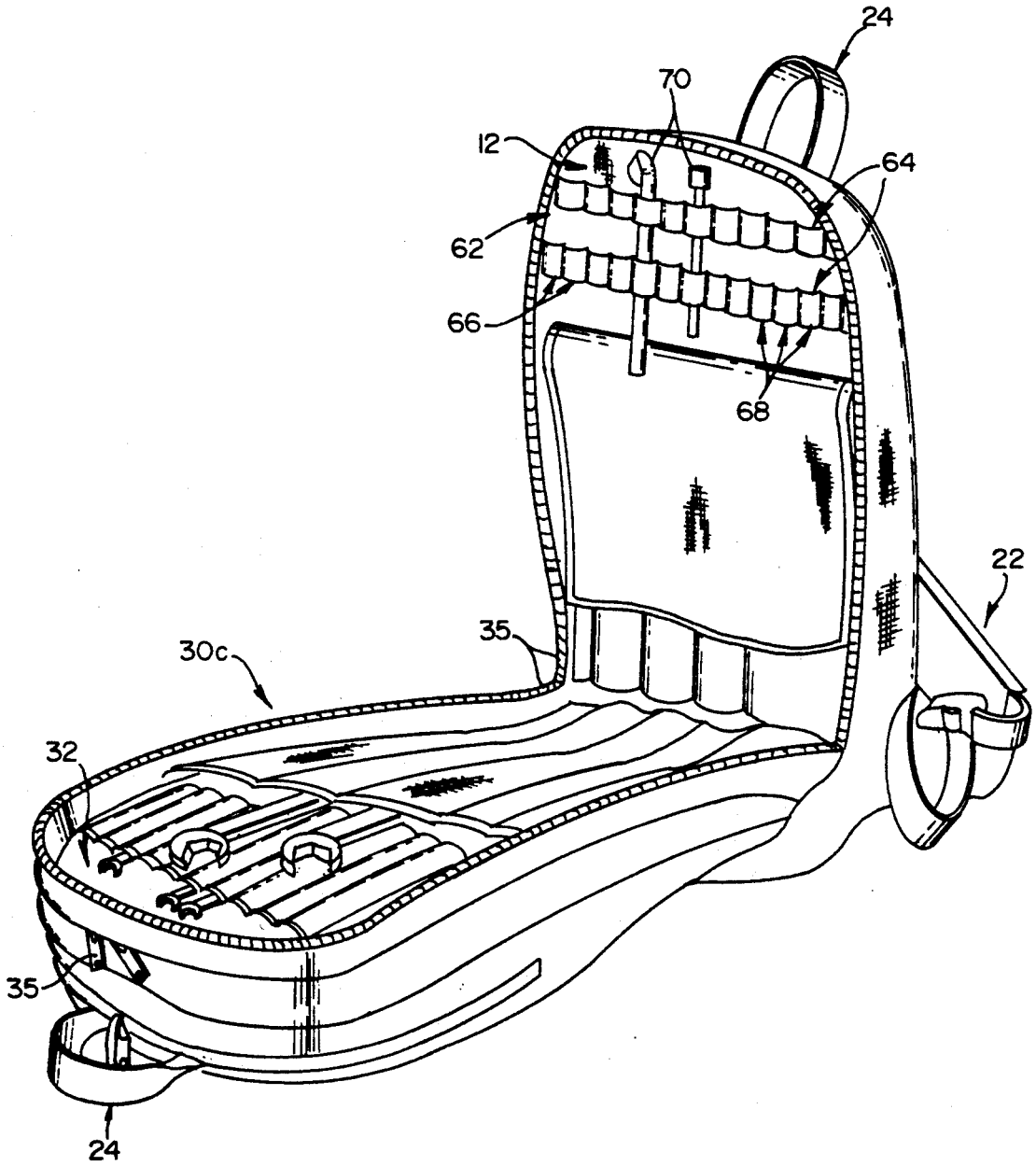
FIG. 5 is a front perspective view of a preferred embodiment constructed in accordance with the present invention showing a tool storage compartment.
Figure 6:
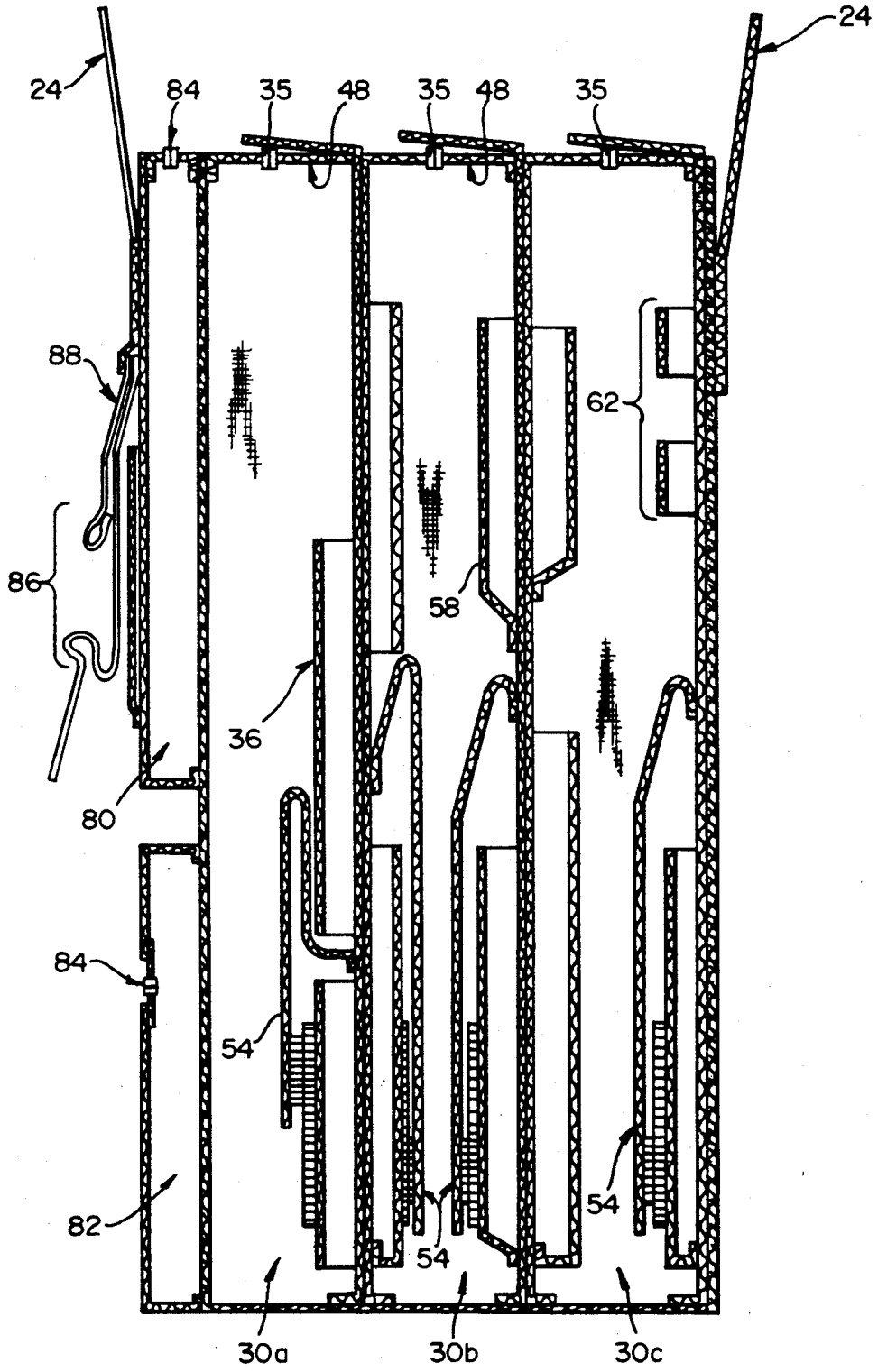
FIG. 6 is a cross-sectional view of a preferred embodiment constructed in accordance with the present invention taken along line 6—6 in FIG. 1.

As shown in detail in FIG.'S 3–5, the internal configuration of the tool kit utilizes a plurality of individual, vertically oriented tool storage compartments 30*a–c*. A plurality of internal panels are used to create the tool storage compartments. Each internal panel is approximately the same size and shape as the front and back panels of the portable tool kit. The internal panels are placed within the external structure of the portable tool kit and oriented so that they are substantially parallel to the plane defined by the front and back panels of the tool kit when the took kit is closed. The edges of each internal panel are attached to the bottom, top and sides of the tool kit by sewing or other attachment means, with the result that each internal panel becomes a structural member of the took kit. Each storage tool compartment is defined by two adjacent internal panels, or the front or back panel and an adjacent internal panel. Those portions of the top, bottom and sides of the portable tool kit which lie between the adjacent panels making up an individual tool storage compartment further define the outer edges of each tool storage compartment. The internal panels can be constructed from two parallel pieces of material. As shown in FIG. 5, tool compartment 30*c* has one panel which is the back panel 12 of the portable tool kit and a first internal panel 32. The tool storage compartment 30*b* is made up of the first internal panel 32 and a second internal panel 34 as is shown in FIG. 4. Tool storage compartment 30*a* shares the second internal panel with tool storage compartment 30*b* and also uses the front panel 14 of the tool kit as shown in FIG. 3. Although the figures show a portable tool kit with three tool storage compartments, the actual number of tool storage compartments in a particular application is limited only by the needs of the user and the practical limit as to structure of the tool kit and ability of the user to carry the weight of the tool kit.

Each tool storage compartment has a separate opening and sealing device. In this particular embodiment, a medium to heavy duty zipper 35 is used as the opening and sealing means. Other devices could be snaps or Velcro material.

Within the individual tool compartments are tool holders of varying configurations designed to hold hand tools of a specific size and shape. There are several different configurations. First tool holder 36 is constructed from a piece of material that is attached to one of the compartment panels in a series of substantially parallel, vertical attachment lines 38. The material is bunched between each pair of vertical lines to form a plurality of pockets 40. Further, the lower edge 42 is also attached to the panel leaving each pocket with one open end 44. One hand tool can then be inserted into each open end of the pockets making up the first tool holder. The vertical attachment lines can be created and attached to the internal panel by sewing, bonding by thermal or sonic welding if proper materials are used. The opening of the pockets must be sufficiently large to allow a hand tool such as a screwdriver 45 to enter, but also sufficiently small to prevent the tool from moving once it is in place. Different sizes of hand tools are accommodated by using a material that slopes downward to form progressively shorter pockets.

There are several different configurations to ensure that once the hand tools have been inserted into the pockets of the tool holders that the edges will stay in place. One is to locate the open ends of the first tool holder near the top 18 of the tool kit so that when the hand tools are inserted into the open end of the first tool holder it is protruding into the hand tools or proximate the top of the tool kit, as shown in FIG. 3. When the tool storage compartments are closed, the top of the tool kit thus forms a lid 48 which prevents the hand tools from escaping from the tool holder.

An alternative configuration is a tool holder which is also shown in FIG. 3 by second tool holder 52. This tool holder is virtually identical in construction to the first tool holder described above. The second tool holder, however, is located lower on the panel of the tool storage compartment where the top of the tool kit cannot act as a lid to prevent the tools from escaping. In this configuration, a lid 54 is created by sewing a substantially rectangular piece of material above the top edge 56 of the second tool holder so that the material can be folded down over the open ends of the second tool holder to prevent the hand tools from escaping. This configuration is also shown in FIG. 4 with the lid 54 in that figure lifted up. The lid can be secured in place by a fastening device 57 such as a snap or Velcro material. As shown in FIG. 4, a tool holder constructed in accordance with the first and second tool holders can have pockets of varying size. In FIG. 4, the pocket 58 is adjusted for the pliers and larger tools which are significantly larger than the pockets shown in FIG. 3 for screw drivers or in FIG. 5 for box end wrenches.

Another configuration for retaining hand tools in place in tool holders is shown in FIG. 4 where across the tops of pockets 58 there is a line or band of elastic 60 which requires some force to insert the hand tool into the pocket and thereafter holds the hand tool in place until a similar force is used to withdraw the hand tool.

A third tool holder 62 illustrates another configuration for organizing and retaining tools within the tool kit and is illustrated in FIG. 5. The third tool holder is constructed from one or more strips 64 of material which run substantially parallel to one another across one of the panels forming a tool storage compartment in a substantially horizontal orientation. As in the tool holders described above, each strip is attached to the panel in a series of second vertical attachment lines 66 that are substantially parallel to one another. The strip forms a pocket 68 between each pair of vertical lines. With the configuration illustrated by the third tool holder, the second vertical lines for each strip are aligned with one another so that the resulting pockets are also aligned, thereby allowing a tool 70 to be inserted through a corresponding pocket in both strips simultaneously.

As with the above discussed tool holders, the attachment of the vertical attachment lines can be formed by sewing, or with the appropriate materials by sonic or thermal welding. The materials used for the strips themselves can be a flexible, non-elastic material which requires the resulting pocket to be only slightly larger than the cross-sectional area of the hand tool to be used in the particular pocket. Nylon strapping material has been used successively in this application. Alternatively, the strip material can be elastic and similar to the elastic band across the top of the tool holder described above and can require force to insert the tool and thereby hold the tool until force is used to remove the hand tool.

Although the tool holders illustrated in the figures described above are all vertically oriented, if one had hand tools which would be more efficiently or more conveniently stored in a horizontal orientation, tool holders of the same configurations described above could be horizontally oriented by substituting a side of the tool kit for a lid as opposed to the top of the tool kit or by using the separately attached lid described in the second tool holder, the hand tools could be held in the tool holders.

The construction of the tool kit itself is in accordance with a conventional method used to construct a backpack, and these methods are well known to those skilled in the art. To maximize flexibility of the tool kit and comfort of those using the tool kit, success has been achieved using a flexible, substantially non-elastic material for the outer panels and the internal panels of the tool kit. These materials are commonly used in construction of backpacks. One material used with success is 1000 denier Cordura®. It has been found in practice that the construction of the tool kit with the plurality of internal panels provides sufficient body structure to be usable without excessive stiffness, especially with the hand tools in place. If additional structure were desired, however, a more rigid but somewhat flexible material could be used for the internal panels, although this might present other difficulty in construction.

In addition to the tool holder configurations used to retain the hand tools in place as described above, the overall configuration and construction of the portable tool pack inhibits movement of hand tools once they are in place in the various tool holders and the tool storage compartments are all sealed. When the tool storage compartments are sealed, the tool holders on the opposing sides of the tool storage compartment apply some pressure against one another which further inhibits the movement of the hand tools from the tool holders.

As shown in FIG'S. 1 and 2, additional miscellaneous storage areas can be provided through pockets 80 and 82 attached to the front panel and opened and closed individually with zippers 84. The external pockets can be arranged in any manner convenient or desired for a particular application. Items which are not usually stored in a pocket or tool storage compartment can also be transported on the portable tool kit by the use of devices such as a carrying loop 86 as shown in FIG. 1. The carrying loop in this particular embodiment is created from a section of nylon strapping 88 attached to a portion of the front panel to be opened and closed with a buckle 90 which also allows adjustment in the size of the loop. The loop can be opened to carry such things as a drop light 92. Storage areas for items other than hand tools also can be provided inside the tool storage compartments. One example of this is the pocket 94 shown in FIG. 3.

Figure 7:
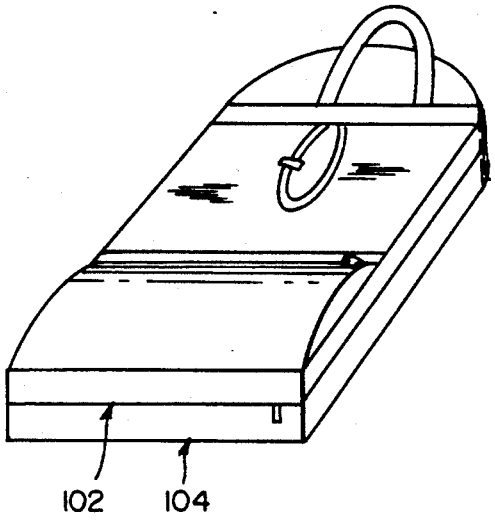
FIG. 7 is a bottom perspective view of a preferred embodiment constructed in accordance with the present invention.

An additional alternative preferred embodiment of the present invention is shown in FIG. 7. In this tool kit, the external structure is virtually identical to the embodiment discussed above in that the external structure is that of a conventional pack. This embodiment also has vertically oriented tool storage compartments. In this embodiment, however, the zippers 102 which serve as the opening and sealing means extend completely around the pack including the bottom 104. Thus, by completely unzipping the internal panel, that panel may be removed thereby reducing the size of the tool kit. This embodiment also allows the interchange of internal panels should the user desire tool holders for a specific set of hand tools that cannot be accommodated by the tool holders already in place. Also, the portable tool kit could be expanded.

Figure 8:
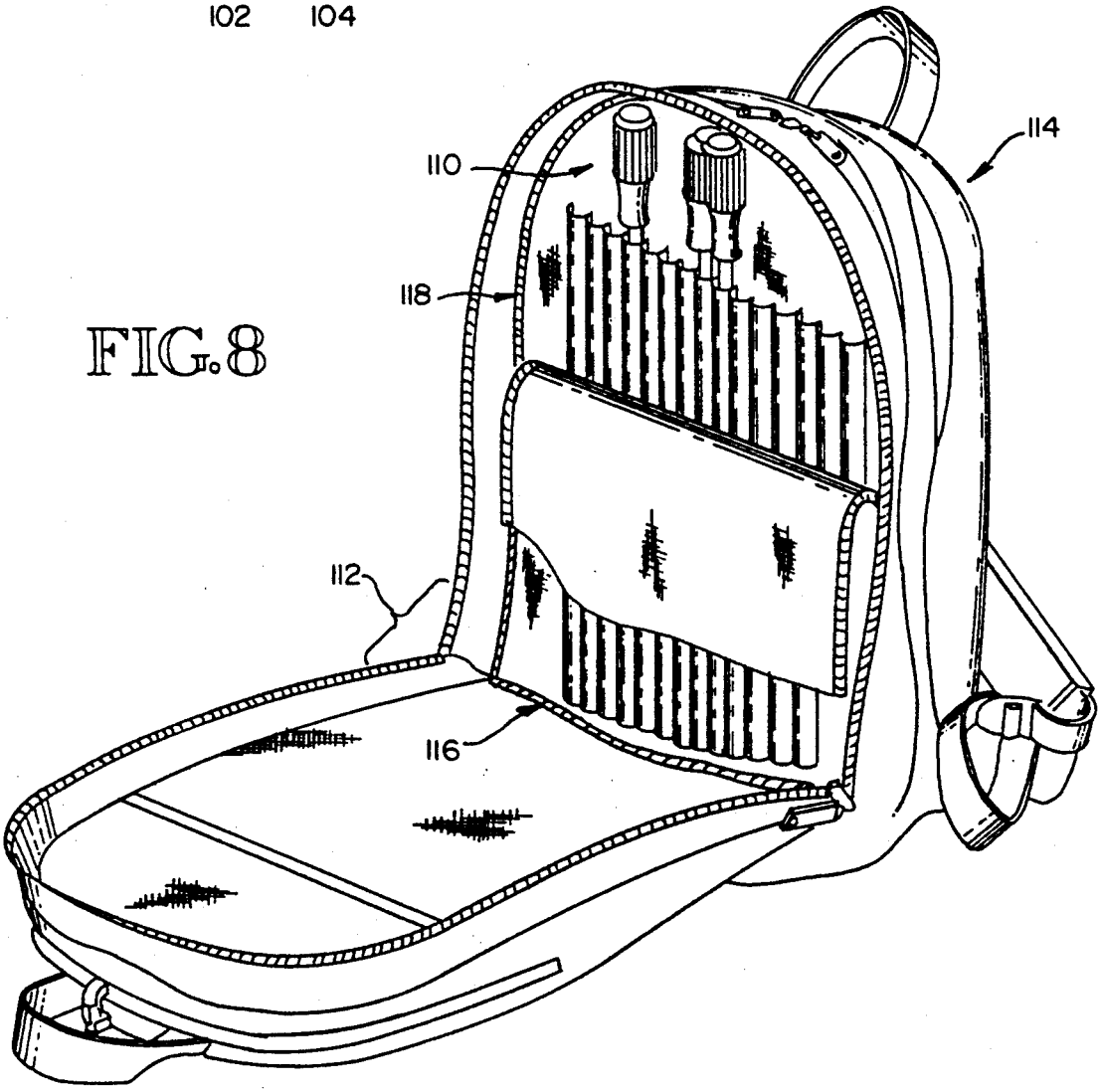
FIG. 8 is a front perspective view of a preferred embodiment constructed in accordance with the present invention showing a tool storage compartment.

FIG. 8 illustrates another alternative preferred embodiment which allows the interchange of internal panels 110 which make up the individual tool storage compartments 112. In this embodiment, there is an outer structure 114 in which individual internal panels are fixedly, but removably attached by an attachment means 116 which could be Velcro, zippers, etc. In this embodiment, some sort of flexible but relatively rigid structural member 118 runs around the outside edge of the internal panels to maintain the shape of the panel. While this embodiment does not allow the expendability of the above alternative preferred embodiment, it does allow the user to substitute internal panels with specialized tool holders.

The tool kit constructed in accordance with the present invention as disclosed in results in a highly portable device for transporting a complete set of hand tools to a repair location while keeping the tools organized and in place regardless of the orientation of the kit during transportation. At the same time, the hands of the individual transporting the tools are left free to deal with any physical obstacles that have to be overcome to reach the desired location. The present invention provides clear advantages over earlier attempts to provide a method for transporting hand tools to a remote repair location.

INDUSTRIAL APPLICABILITY

The present invention is applicable in any situation where it is necessary for an individual to transport a large number of individual items to a remote location, especially when that individual needs to have his hands free during transportation. It is especially useful for items that are not easily packed or organized when a carrying device is simply an open space.

In compliance with the statute, the invention has been described in language more or less specific to structural features. It is understood, however, that the invention is not limited to the features shown, but it is believed that the construction herein disclosed comprises preferred forms of putting the invention into effect. Therefore, the invention is claimed in any of its forms or modifications within the legitimate and valid scope of the appended claims.

I claim:

1. A portable tool kit rucksack, comprising:

a rucksack main body having flexible front, rear, top, bottom and side panels connected together so as to define an interior volume, the main body also having two arm straps connected to the back panel so that a user can carry the rucksack in a conventional manner:

an internal, flexible panel connected to the top, bottom and side panels together with the front and rear panels defining first and second internal compartments for containing tools;

a first zipper located in the side and top panels between the front and internal panels permitting access to the first internal compartment;

a second zipper located in the side and top panels permitting access to the second internal compartment; and, a tool holding structure on any selected one of four interior walls defined by either the front, back or internal panels and the interior volume, the tool holding structure having upper and lower tool holding pockets connected to the selected interior wall, each pocket further having open upper and lower ends, the tool holding structure further including an elongated flap having a free lower edge and a fixed upper edge connected to the selected interior wall between the upper and lower pockets so as to form a moveable top closure for the lower pocket and a relatively fixed bottom closure for the upper pocket, the pockets being located with respect to the selected interior wall so that the top panel of the main body forms a relatively moveable top closure for the upper pocket and the bottom panel of the main body forms a relatively fixed bottom closure for the lower pocket, whereby the rucksack remains substantially flexible to follow the motion of the user even when the pockets are loaded with a plurality of different sized tools.

2. The portable tool kit rucksack of claim 1, wherein the free edge of the elongated flap and opposite lateral edges of the lower pocket have horizontally and vertically adjustable closure mechanisms so that different tools of varying height can be snugly accommodated in the lower pocket simultaneously.

3. The portable tool kit rucksack of claim 1, wherein the back and front panels of the main body have corresponding, opposed lift strap loops allowing the rucksack to be temporarily closed and lifted thereby if one of the zippers is opened and the remaining zipper is closed without spilling any tools in the pockets.

4. The portable tool kit rucksack of claim 1, wherein one of the panels has a trouble light loop attached thereto and the trouble light loop has an adjustable buckle therein for securing a trouble light to the rucksack.

* * * * *